US007121316B2

(12) United States Patent
Biggers

(10) Patent No.: US 7,121,316 B2
(45) **Date of Patent: *Oct. 17, 2006**

(54) SHUTTER WINDOW/DOOR AND METHOD

(76) Inventor: Douglas W. Biggers, 526 Allendale Rd., Key Biscayne, FL (US) 33149

( * ) Notice: Subject to any disclaimer, the term of this patent is extended or adjusted under 35 U.S.C. 154(b) by 292 days.

This patent is subject to a terminal disclaimer.

(21) Appl. No.: 10/783,012

(22) Filed: Feb. 23, 2004

(65) Prior Publication Data

US 2004/0226668 A1 Nov. 18, 2004

Related U.S. Application Data

(63) Continuation-in-part of application No. 09/612,137, filed on Jul. 7, 2000, now abandoned, which is a continuation of application No. 08/902,116, filed on Jul. 25, 1997, now Pat. No. 6,148,895, which is a continuation of application No. 08/650,802, filed on May 20, 1996, now abandoned, which is a continuation-in-part of application No. 08/400,441, filed on Mar. 6, 1995, now abandoned, which is a continuation of application No. 08/179,221, filed on Jan. 10, 1994, now abandoned.

(51) Int. Cl.
*E06B 3/48* (2006.01)

(52) U.S. Cl. ..... 160/183; 160/193; 160/207

(58) Field of Classification Search ..... 164/135, 164/183, 193, 84.01, 84.04, 84.05, 84.06, 164/188, 201, 206, 207, 35; 52/202, 203
See application file for complete search history.

(56) References Cited

U.S. PATENT DOCUMENTS 2,351,656 A 6/1944 Auten
2,641,018 A 6/1953 Snyder
3,401,734 A 9/1968 McCabe
3,516,470 A 6/1970 Kurz
3,670,797 A * 6/1972 Sassano ..... 160/118
3,924,671 A 12/1975 Gates
4,037,639 A 7/1977 Jones
4,128,120 A 12/1978 Frey
4,433,714 A 2/1984 Barber
4,634,172 A 1/1987 Duda
4,644,724 A 2/1987 Schijf
4,723,588 A 2/1988 Ruppel
4,972,894 A 11/1990 Machill
5,097,883 A 3/1992 Robinson et al.
5,099,904 A 3/1992 Susner
5,469,905 A 11/1995 McKinney et al.

(Continued)

*Primary Examiner*—Blair M. Johnson
(74) *Attorney, Agent, or Firm*—Robert J. Van Der Wall

(57) ABSTRACT

A shutter system is disclosed which is unitized in a single rectangular frame or bracket with a window or door for use in a building opening that includes a plurality of shutter plates that can be folded and unfolded, each of the shutter plates having a hinged joint with adjoining shutter plates. The rectangular bracket has guide members with tracks for guiding the shutter plates using extensions with rollers from each of the hinged joints to cooperate with the guide members. There are also further extensions at the ends of the shutter plates on no less than every other plate, each of these securing wheel carriers at the end of the shutter plate and within a track in the rectangular bracket. The wheel carriers are equipped with a spring to put the secured shutter plate in tension because this adds additional strength to the shutter plates to resist bending and impact of the shutter system when in a fully deployed configuration.

20 Claims, 12 Drawing Sheets

U.S. PATENT DOCUMENTS 5,549,148 A 8/1996 Figueiredo et al.
5,566,739 A 10/1996 Hoffman
5,740,850 A 4/1998 Hoffman
5,857,298 A * 1/1999 Fullwood ..... 52/202
6,148,895 A 11/2000 Biggers
6,463,988 B1 * 10/2002 Mullet et al. ..... 160/201
6,755,231 B1 * 6/2004 Biggers ..... 160/183

* cited by examiner

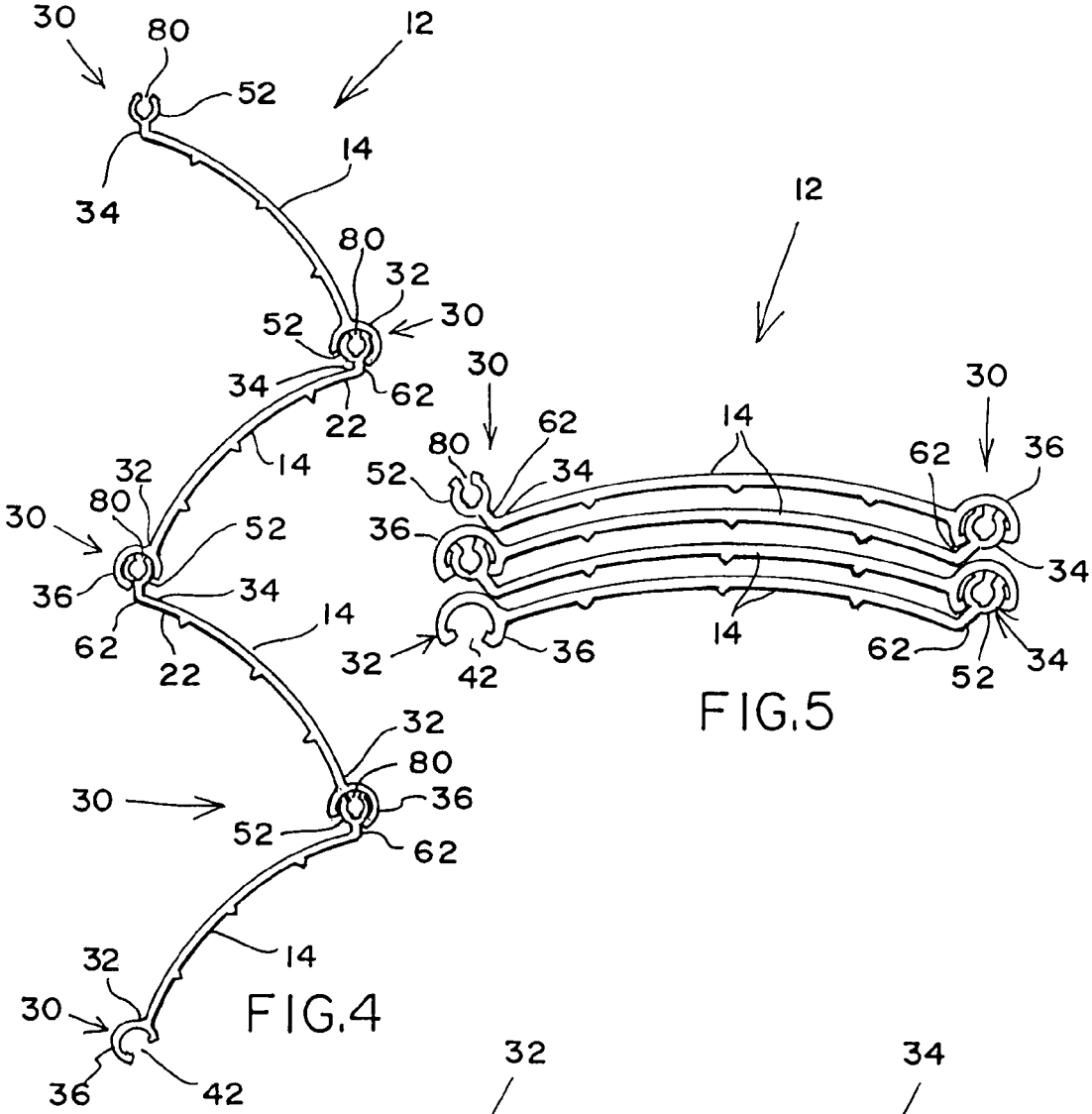
FIG.4
FIG.5
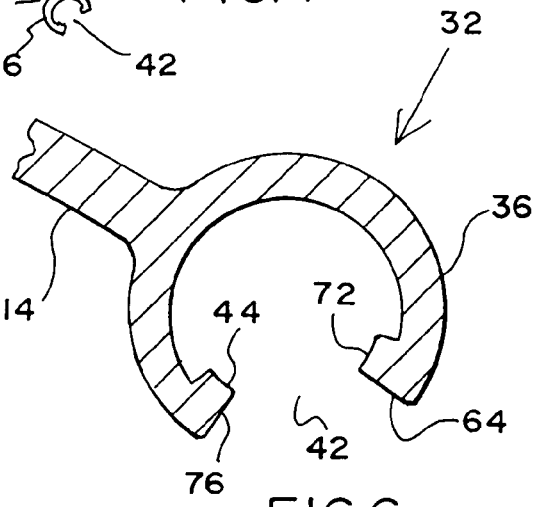
FIG.6
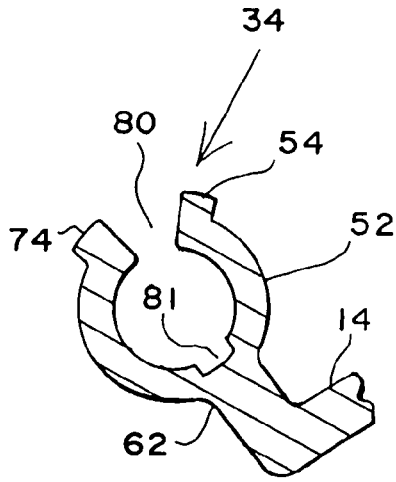
FIG.7

SHUTTER WINDOW/DOOR AND METHOD

CROSS-REFERENCE TO RELATED APPLICATIONS

This Application is a Continuation-In-Part of application Ser. No. 09/612,137, filed Jul. 7, 2000 now abandoned; which is a Continuation of application Ser. No. 08/902,116, filed on Jul. 25, 1997, now U.S. Pat. No. 6,148,895; which in turn is a Continuation of application Ser. No. 08/650,802, filed May 20, 1996, abandoned; which is a Continuation-In-Part of application Ser. No. 08/400,441, filed Mar. 6, 1995, abandoned; which is a Continuation of application Ser. No. 08/179,221, filed Jan. 10, 1994, abandoned.

FIELD OF THE INVENTION

The present invention relates to the construction of buildings, and more particularly closures for windows or doors. Specifically the invention relates to closures for a window or a door in which the unit is completely assembled, framed, and includes a shutter system suitable for operations in areas where hurricane resistant closures are desired.

BACKGROUND OF THE INVENTION

In the constructions of buildings, particularly housing of large scale, low cost dwellings, the cost of installing windows and doors is magnified by the necessity for utilizing several trades in order to frame-in the window, and then place the window in position, and subsequently provide for a shutter system suitable for withstanding hurricane loads, as required by the Southern Florida Building Code, Miami-Dade County Code, and similar codes.

Contractors normally contract out the plumbing, excavation, slab, and masonry work which is usually concrete block. Therefore, what is desired is a product which is factory dimensioned to close tolerances which includes not only a frame for the window or the door, but an integral shutter system which can be selectively employed to secure against intrusion, burglary, vandalism, wind storms, hurricanes, and the like. Recent building codes have required masonry block contractors to frame in building opening with cast concrete which results in tolerances of ¼ inch or less on each side of the opening and also as to top and bottom. Planarity is insisted upon on the tops and sides, whereas the bottom of the opening is left to finishing at the time the opening is filled with a window, door, screen complex, or other structural member. As a result, closer dimensional tolerances are required for the installation of windows, doors, and particularly storm shutters. Working to these tolerances also requires ongoing installation steps which, when supplied with dimensionally stable frames and closures, are easier to fulfill.

DESCRIPTION OF THE PRIOR ART

The art of shutters and panels for covering openings in buildings and vehicles is long standing. Some of these structures have been intended for protection against storm winds and flying debris, and yet lack sufficient strength to do the job reliably. In addition, individually bolted panels can be awkward or unappealing because they are bulky, obstructive and conspicuous, or have too many separate parts to be economical to manufacture. Moreover, these panels all require extra storage space off season.

U.S. Pat. No. 4,634,172, issued Jan. 6, 1997 to Duda, discloses a rain sealing mechanism for securing a panel to a recreational vehicle. The panel shown in the Duda patent is intended to be merely incidental to a flexible connector which secures the panel. Yet for purposes of the present application, the Duda panel is of greater interest. Duda illustrates a deployable panel formed of a series of elongate plates having pivotally interlocking opposing edges including a C-shaped rail along one edge and a bead along the opposing edge. The rail and bead are sized so that the bead of one plate is retained within the rail of an adjacent plate. The composite panel is stored by gathering the interlocking plates into a roll on a spool. The width of the opening in the C-shaped rail is such that the adjacent panel abuts one edge of the opening when the panel is fully opened and abuts the other opening edge when the panel is fully closed. A problem with Duda, if used for storm protection, is that the deployed panel presents a substantially planar composite sheet which is relatively susceptible to bending and crushing failure from object impact. Another problem is that the locking strength of the plate edge structure is limited to the abutment of a plate face against a single opening edge in an adjacent plate. Still another problem is that the plates forming the panels cannot be collapsed face-to-face for compact storage.

U.S. Pat. No. 4,128,120, issued Dec. 5, 1978 to Frey, and U.S. Pat. No. 4,644,724, issued Feb. 24, 1987 to Schijf, both reveal panels made up of plates very similar to those of Duda. Frey and Schijf once again have a C-shaped channel along one plate edge interlocking with a bead along an adjacent plate edge, and open into a substantially planar configuration. As a result, Frey and Schijf present the problems of Duda.

U.S. Pat. No. 4,433,714, issued Feb. 28, 1984 to Barber, teaches a roller shutter door formed of a series of horizontal plates with pivotably inter-engaged edges. One edge is curved back over the plate to form a C-shaped cross-section, and the opposite edge is curved back over the opposite side of the plate in a slightly smaller C-shaped cross-section. The smaller C-shaped edge of one plate fits into the larger C-shaped edge of an adjacent plate. To reduce slack between the interlocking plate edges, a strip of resilient material is placed inside the smaller C-shaped edge. The plates are bowed to provide a certain degree of corrugation in the deployed panel, but there is a lack of strength at the edge joints which is similar to that described above for Duda. Another problem is that the plates are all convex in the same direction, and thus cannot be collapsed face-to-face into a compact stack.

U.S. Pat. No. 3,516,470, issued Jun. 23, 1970 to Kurz, illustrates a removable storm shutter including a series of hingedly interlocking plates. These plates ride in side channels to collapse substantially in a stack and to deploy into a substantially planar storm panel. Kurz presents the problems identified for Duda. The cross-sectional shape of the plates prevents them from collapsing to an extent that hinges abut; see FIG. 3.

U.S. Pat. No. 4,723,588, issued Feb. 9, 1988 to Ruppel, and U.S. Pat. No. 4,972,894, issued Nov. 27, 1990 to Machill, disclose similar versions of a roller shutter or curtain. The shutters are formed of a series of elongate plates, each having two spaced apart sheet metal face portions closed at their mutual edges. The plates are either left hollow, or are filled with an insulating material. A C-shaped channel is formed at one longitudinal edge, having a flange engagement portion extending part way across its open end. The other longitudinal edge is bent back into a hook-shaped curve to fit into the channel of an adjacent plate and to hingedly interlock with the flange engagement portion along the channel. The problems of Ruppel and Machill are similar to those of Kurz and Duda. Also, as in Barber, the plates are all convex in the same direction, preventing compact face-to-face collapse.

U.S. Pat. No. 5,099,904, issued March 31 to Susnar, reveals a folding security shutter. The Susnar shutter is formed of an interlocking series of vertical plates riding in top and bottom tracks. During assembly, a bead on each plate longitudinal edge slides into one of two channels in a separate hinge strip. One hinge strip is needed to connect each adjacent pair of plates edges. A problem with Susnar is that the plates and hinge strips are separate pieces, requiring the cost of two extrusions rather than one, and the further cost of assembling the hinge strips and plates.

Panels formed of plates which do not collapse face-to-face include those disclosed in U.S. Pat. No. 4,972,894, issued Nov. 27, 1990 to Machill; U.S. Pat. No. 4,128,120, issued Dec. 5, 1978 to Frey; and U.S. Pat. No. 4,037,639, issued Jul. 26, 1977 to Jones. The plates of U.S. Pat. No. 3,924,671, issued Dec. 9, 1975 to Gates, fold convex face to convex face and thus do not become fully compact. Still other patents covering loosely related subject matter include U.S. Pat. No. 2,351,656, issued Jun. 20, 1944 to Auten; U.S. Pat. No. 3,401,734, issued Sep. 17, 1968 to McCabe; and U.S. Pat. No. 2,641,018, issued Jun. 9, 1953 to Snyder.

Over the course of the prosecution of the parent Application, Examiner Blair Johnson cited the following references: U.S. Pat. No. A 790,632 to Hall; U.S. Pat. No. 3,670,797 to Sassano; U.S. Pat. No. 3,924,671 to Gates; U.S. Pat. No. 5,097,883 to Robinson et al.; U.S. Pat. No. 5,469,905 to McKinney et al.; U.S. Pat. No. 5,549,148 to Figueiredo et al.; U.S. Pat. Nos. 5,566,739 and 5,740,850 both to Hoffman; and U.S. Pat. No. 6,148,895 to Biggers the Applicant of the present invention.

All of the above identified patents fail to show a working combination of a door or window in combination with an integral pre-dimensioned frame which includes a retractable shutter system of the type necessitated for hurricane protection, prevention of vandalism and burglary, and the like. Hence Applicant has not only a novel shutter system for panels to insert in a building opening but the shutter system and its frame ultimately include an integral window or door for installation as a unified package in a building opening.

It is thus an object of the present invention to provide a folding storm panel package which forms a composite panel with pronounced corrugations when deployed, for reliable strength in protecting its self-contained window or door against wind-driven projectiles.

It is another object of the present invention to provide such a panel and window or door package which has double-locking characteristics for stronger joints between deployed plates, again to withstand projectile impact.

It is another object of the present invention to provide such a shutter panel package formed of plates which are cross-sectionally bowed for strength across a wide span and yet are configured cross-sectionally to be capable of collapsing face-to-face and thus occupy minimal space.

It is still another object of the present invention to provide such a panel package in which each plate and its plate hinge structures may be extruded together as one piece for simplicity and minimized cost.

It is finally an object of the present invention to provide such a shutter panel window or door package which is relatively inexpensive to manufacture, install and maintain. A related object of the invention is to develop a system for installing the shutter panel, window or door package with shimming, and fitting techniques, accommodating the tighter dimensional standards now being directed to contractors.

In view of the foregoing, it is a principal object of the present invention to provide a pre-dimensioned system including a window or a door in combination with the frame for the window or the door, and in which the frame mounts a shutter system for raising or lowering, and which in the lowered position will conform with the vast majority of the building codes with regard to hurricane protection. As such, withstanding winds of 125 mph, and withstanding the impact of a 6 ft. 2×4 at 34 mph are exemplary of the requirements that the shutter must meet.

SUMMARY OF THE INVENTION

The present invention evolved from the development of a single generally rectangular frame, with extruded guides on the lateral sides, which guides contain tracks for a retractable shutter system, and similarly contain channels for the mounting of a window or a door. Important to the invention is the universality of the channels for mounting the windows or the doors so that a wide variety of commercial window or door structures may be employed with the shutter system. On the other hand, the shutter system utilizes pleated plates which are desirably formed from a single extrusion and cut to length in accordance with the dictates of the width of the opening. At the ends of the shutter panels, provision is made for a guide assembly which is secured internally of the tracks on the lateral sides of the frame. The bottom of the frame structure is left open so that the window can be inserted from the bottom, or the door can be inserted from the bottom thereby providing a cover at the top against the ingress of rain or other contaminants, while permitting drainage from the bottom. In some applications such as a beach house, the window or door may be omitted, and yet the building fitted securely with a pre-packaged frame and shutter system. Also, a plate glass picture window may be protected by the instant shutter system. In one embodiment, means are provided for removing and replacing the shutter system and shutter panels, simply and expeditiously, which does not require the removal of any cement, stucco, or any other permanent securing materials. Replacement with a different set of shutters, or even replacing single panels, and replacing the same is accomplished inexpensively and non-destructively.

A more specific aspect of the invention includes a mounting which ensures that the plates which form the shutter panel will be held in tension. A concomitant feature results from the utilization of a tension member on both sides which engages the lowest one of the plates, thereby upon lifting, no secondary jam or cross bar is required to support the weight of the plurality of plates which form the panel of the shutter.

Various options are available for the positioning of the guide mechanism, that is, at the mid-portion of the plates, or at an outer or inner edge. In addition, the tension means for raising the unit may be applied separately, depending upon where the guide means are located in the track.

DESCRIPTION OF ILLUSTRATIVE EMBODIMENTS

Further objects and advantages of the present invention will become apparent as the following description proceeds, taken in conjunction with the accompanying illustrative drawings in which:

FIG. 1 is a perspective view of a building normally having two or more doors and two or more windows. Each of the building openings are developed to accept a window or a door frame. Exploded perspectives appear of an exemplary door and window. In addition there is a depiction, somewhat diagrammatically, of the two frames complete with shutter system lying flat in anticipation of either a door or a window being inserted from the bottom;

FIG. 4 is a close-up side view of four plates of the inventive panel in the deployed position showing the edge hinge structures in greater detail;

FIG. 5 is a close-up side view, as in FIG. 4, with the panel plates in the folded position;

FIG. 6 is a close-up side view of a first tubular portion of a plate edge, illustrating the first and second inwardly projecting stop flanges;

FIG. 7 is a close-up side view of a second tubular portion of a plate edge, illustrating the first and second outwardly projecting stop flanges;

DESCRIPTION OF THE FIRST EMBODIMENT

Figure 1:
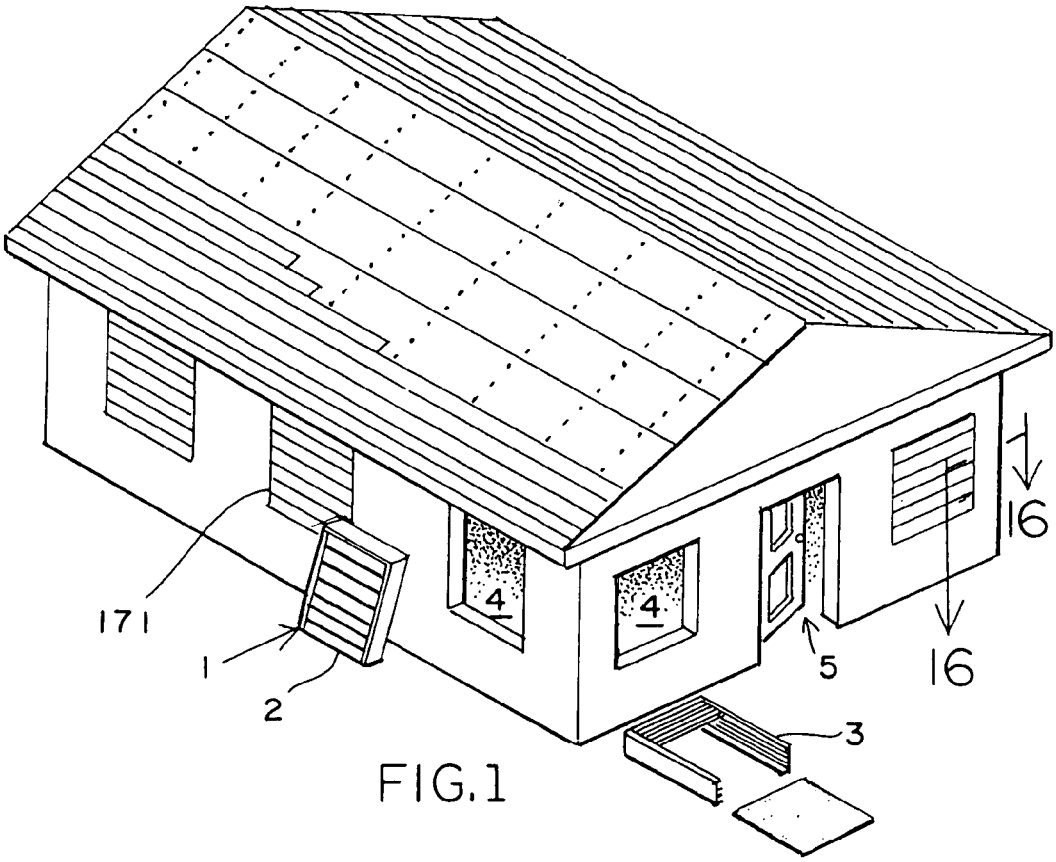

All embodiments of the subject invention include a window or door combination 1 which includes either a window 2, or a door 3. Each of the respective windows 2, or doors 3, fit into a window opening 4, or a door opening 5. These are shown, not in great detail in FIG. 1, but are illustrative of how the entire system can be manufactured and delivered to the job site, where the window or door is to be installed.

Figure 2:
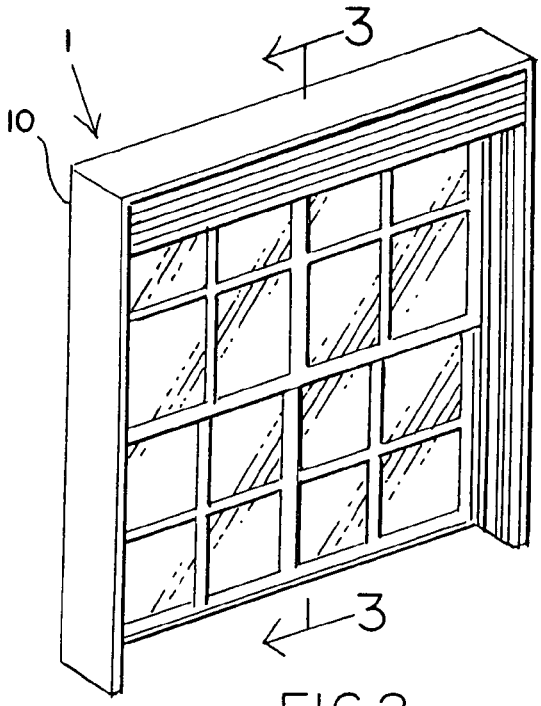
FIG. 2 is a front view of a typical illustrative window system to show the relationship between the shutter and the contained window in the interior portion.
Figure 3:
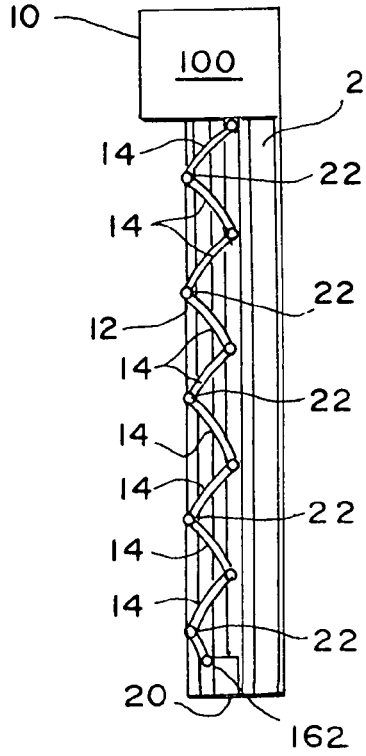
FIG. 3 is a cross-sectional view of the window of FIG. 2 illustrating the accordion configuration of the closed and deployed panel and its respective plates, and more particularly showing their relationship with the interior window.

As best shown in FIGS. 2 and 3, the composite frame 10 surrounds the sides and top of the window/door shutter combination 1. To be noted is that the lower portion is left open for purposes of securing, in accordance with the mandates of the job site.

Particularly as shown in FIGS. 2 and 3, the composite frame 10 is covered by a panel assembly 12. The panel assembly 12, in turn, is formed when a plurality of plates 14 are permitted to lower between the two sides of the composite frame 10 and cover, with all of the plates 14 extended, the preselected building opening 16 into which the window 2 or the door 3 will be inserted in combination with the window/door shutter combination 1.

Figure 8:
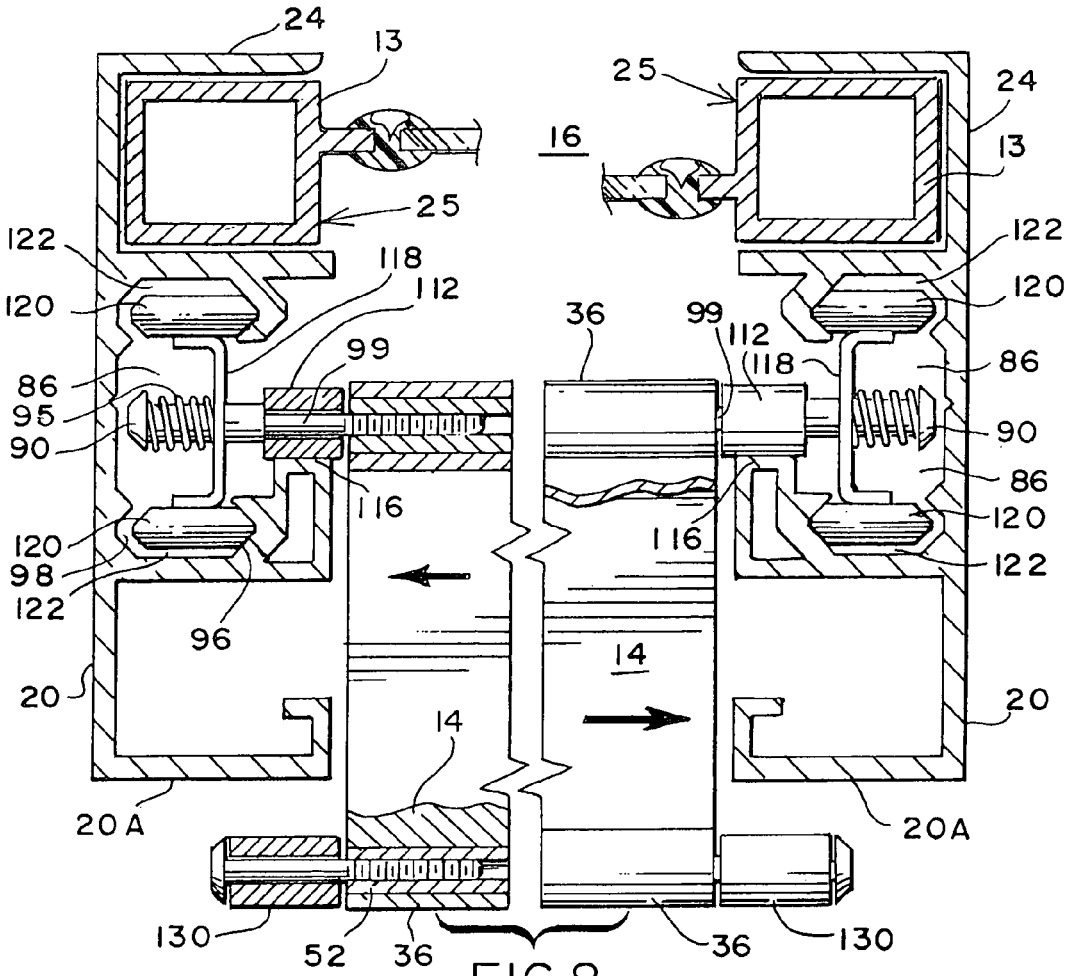
FIG. 8 is a cross-sectional top view of the inventive guide members and the ends of a plate riding in the guide members.

Turning now to FIG. 8, it will be seen that the side extrusions or lateral guide members 20 run from top to bottom on the lateral sides of the composite frame 10, and contain inner tracks 96 and outer tracks 98. Describing the plates 14, as illustrated in FIGS. 4 through 7, and 11 through 13, attention is directed to the specific of the sides 20 or more specifically referred to as lateral sides guide members 20. As noted in FIG. 8, the sides 20, at the rear portion have U-shaped holder 24 defining a window or door 13 receiving channel area 25 which is on the interior portion of the sides 20 when mounted in a dwelling.

Figure 9:
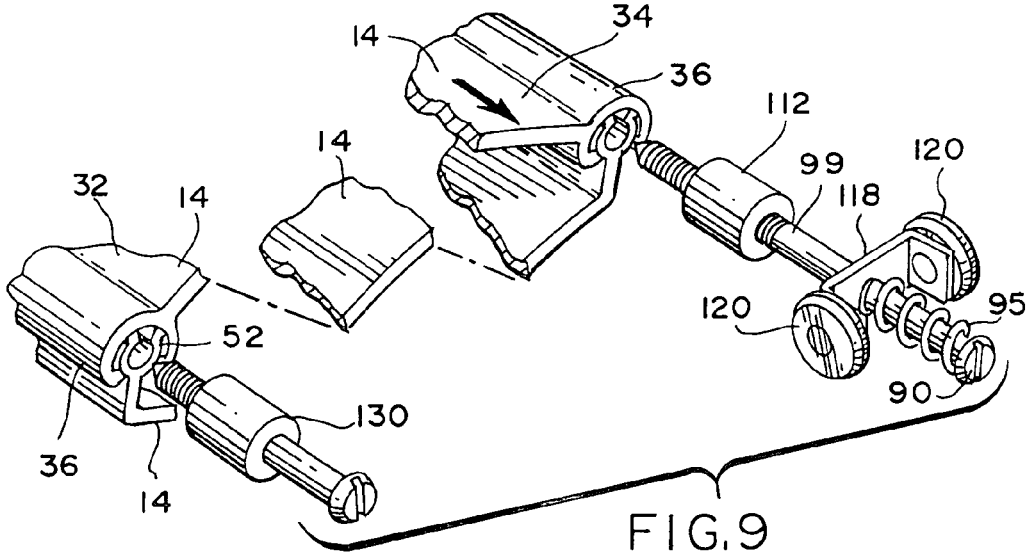
FIG. 9 is a fragmented perspective view of an end of a panel plates showing, in exploded relation to their plate mounting positions, the guide and opening stop assemblies of the first embodiment. Portions of panel plates interconnected with the fragmented plate are also shown.

In FIG. 8, it will also be seen that the central portion of the sides 20, which is utilized for the guide mount assembly 90 is formed to have inner tracks 96 and outer tracks 98. Guide slide stop 116 provided interiorly of the inner tracks 96 are engaged rollingly by the guide inner roller 112. The wheel carrier 118 is secured to its respective plate 14 by means of the guide mount assembly 90 which, as shown in FIG. 9, engages coil spring 95 and wheel carrier 118, ultimately secured by the guide plate connector 99 to its adjacent plate 14.

The coil spring 95 and the dimensions of the wheels 120 are so proportioned and oriented that the compression of the coil spring 95 on the wheel carrier 118 translates into a compressive force on the inner track 96 direction of force (arrows), which in turn, reacts to place the guide mount assembly 90 and the guide plate connectors 99 to apply a tension force (arrows) to the plate 14. This tension force, importantly, when taken in conjunction with the corrugations 22 plate structure to be described hereinafter, imparts additional rigidity to the plates 14, particularly because the plates are curvilinear and oriented convex downwardly.

Figure 15:
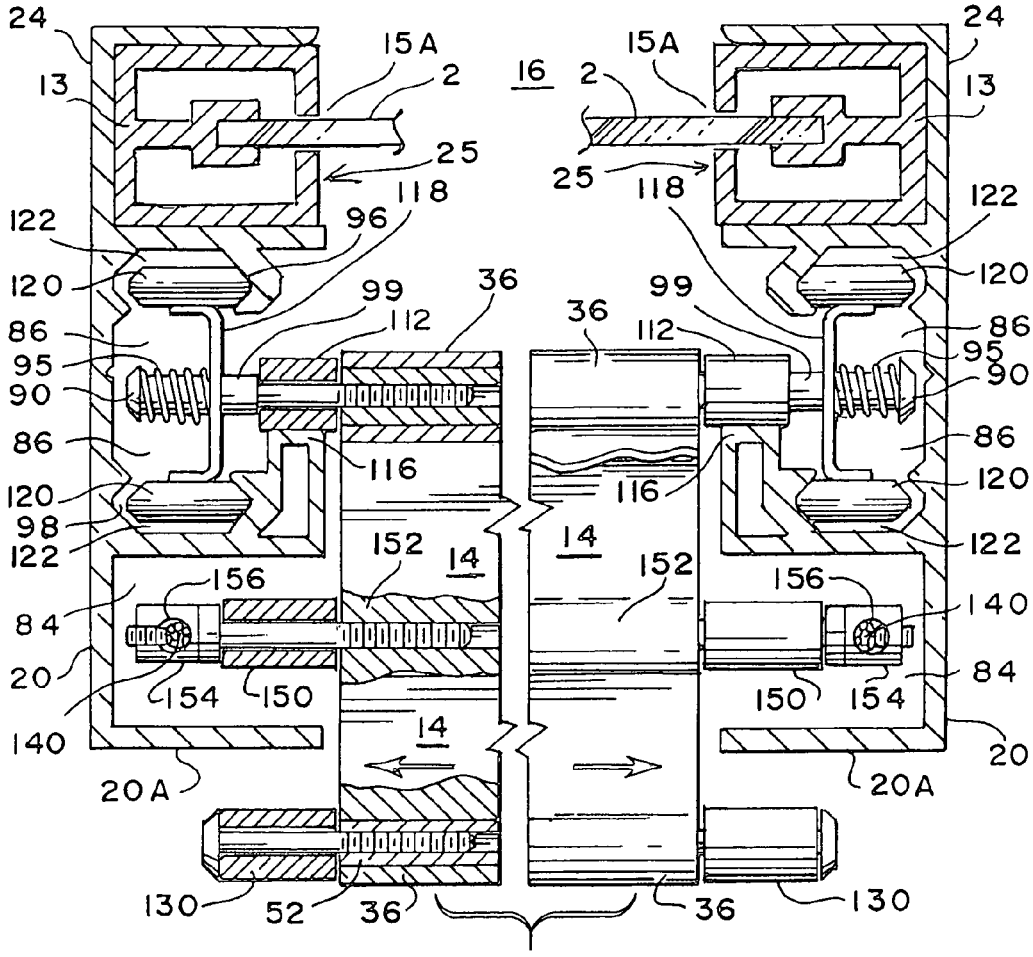
FIG. 15 is a cross-sectional top view of the apparatus, as in FIG. 8, with the rope engaging assemblies added, as described in the description of the second preferred embodiment.

As noted in FIGS. 8 and 15, the opening stop assembly rollers 130, on the exterior portion of the plates 14, will rollingly engage the outer guide channel 20A when deployed. Similarly, the guide inner roller 112 engages the guide slide stop 116 of the guide chamber 86.

The plurality of folded plates 14, and their respective hinge assemblies 30 are illustrated in detail in FIGS. 4 through 7. There it will be seen that each plate 14 has an end. These ends are either the plate outer edge 32, or the outer tube portion 36. The plate outer edge 32 is the upper face and therebeneath is the concave inner face. The plates 14 are oriented so that each of the plates 14 faces convex downwardly to thereby present a stronger structure in the fully deployed or retracted configuration. As will be noted in cross-section in FIGS. 12 and 13, the plate inner edge 34 is designed to be slidably secured interiorly of the outer edge tube portion 36 through the outer edge slot 42 thus defining hinge assembly 30.

Figure 12:
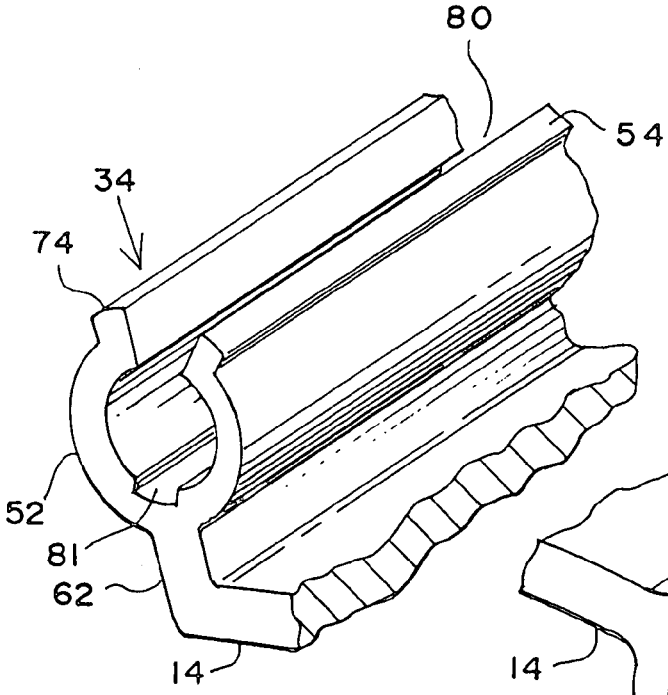
FIG. 12 and 13 are broken away perspective close-up views of the hinge structure first and second tubular portion of a given plate, common to both preferred embodiments.
Figure 13:
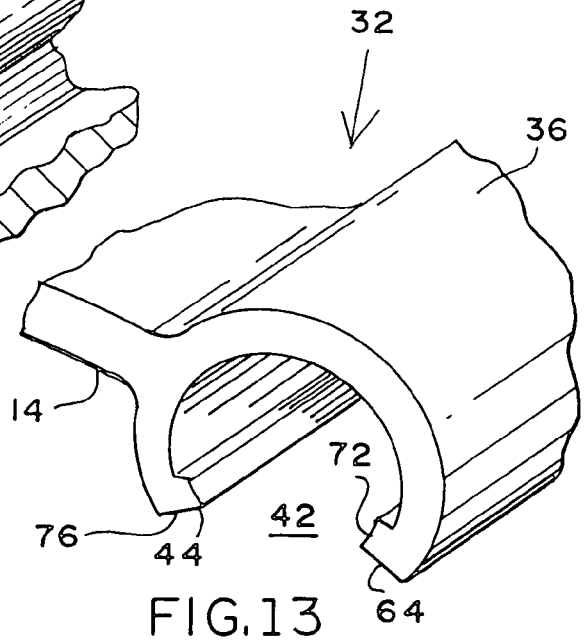

The inner tube portion 52, as shown in FIG. 12, has an inner stop flange 54 and an inner stop 74. The outer tube portion 36 has an outer edge slot 42 which receives the smaller plate inner edge 34. The stops 54, 74 of the plate inner edge 34 are proportioned to engage the corresponding inner stop 76 and the outer stop 72 of the large outside tube portion 36. The stops 54, 74 are separated by inner slot 80. A drain groove 81 is formed opposite the inner slot 80. In such a structure, the ends or lateral edges of the plates 14 can be stacked or pleated to the configuration in the folded state, as best illustrated in FIG. 5. In FIG. 5 it will be seen that the adjacent plates actually have tangential contact each with the other which holds the folded pleated plates 14 of the stored panel assembly 12 to an irreducible minimum in thickness, and therefore handily stores interiorly of the optional top storage member 100.

Figure 10:
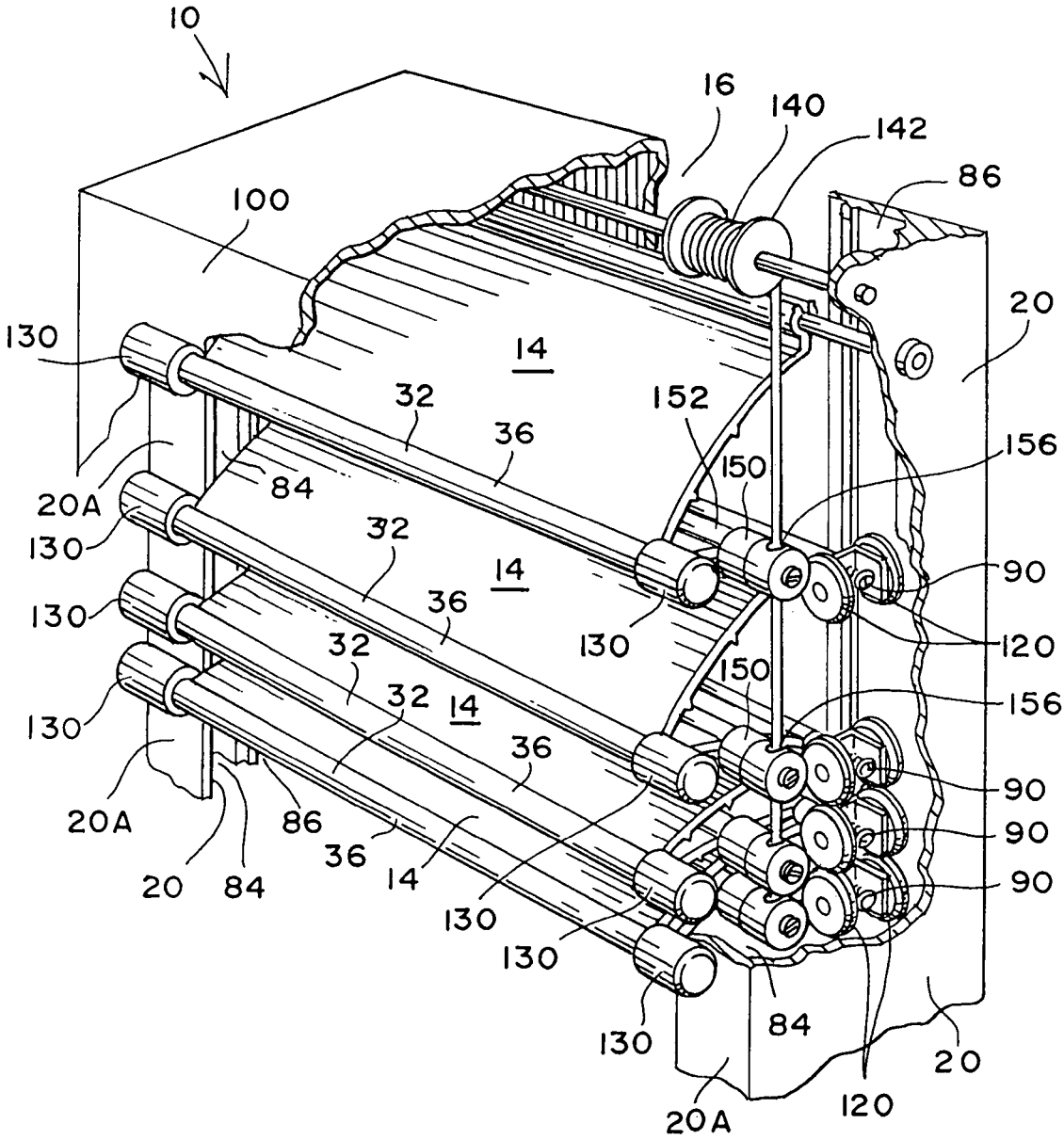
FIG. 10 is a perspective view of a building opening fitted with the second embodiment of the inventive panel package, shown in a partially deployed position. One of the channel members is broken away to reveal the rope, spool and rope engaging assemblies at an end of every other plate in the panel.
Figure 14:
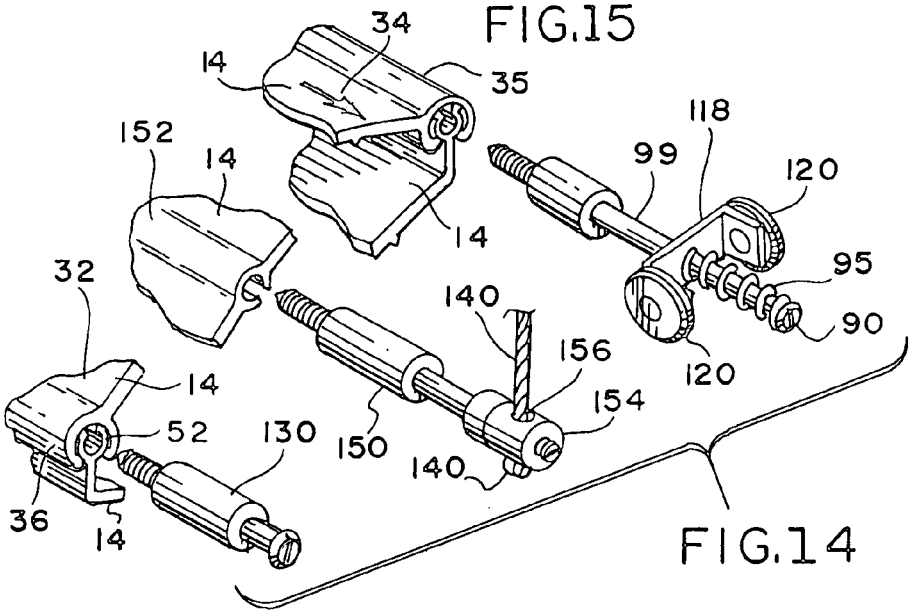
FIG. 14 is a fragmented perspective view of an end of a panel plate, as in FIG. 9, showing in exploded relation to their plate mounting positions the fastener guide and fastener opening stop assemblies of the first and second embodiments, and the rope engaging assembly of the second embodiment only. Portions of panel plates interconnected with the fragmented plate are also shown.
Figure 16:
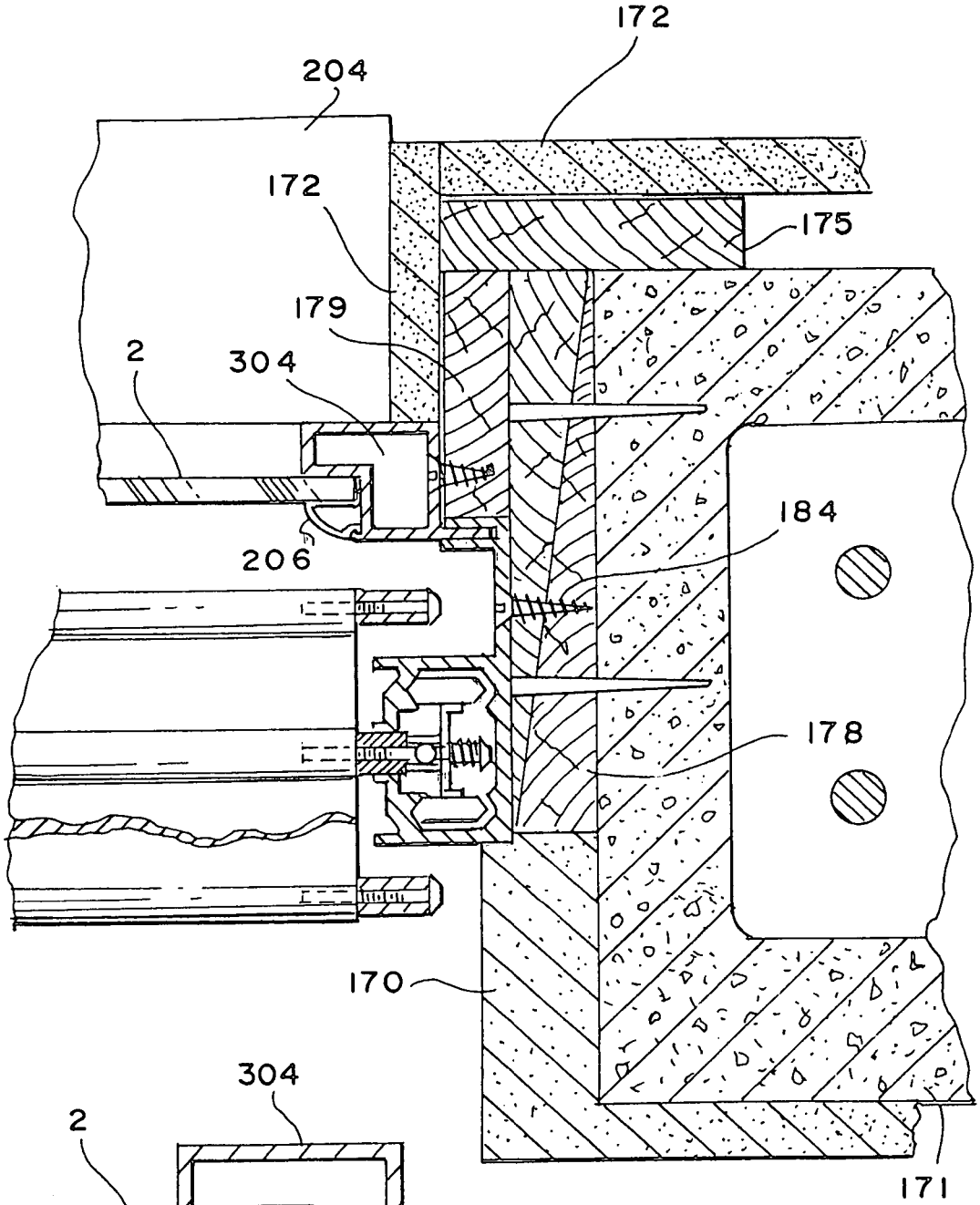
FIG. 16 is a transverse sectional view through a typical fixed glass window showing the details of the installation.
Figure 20:
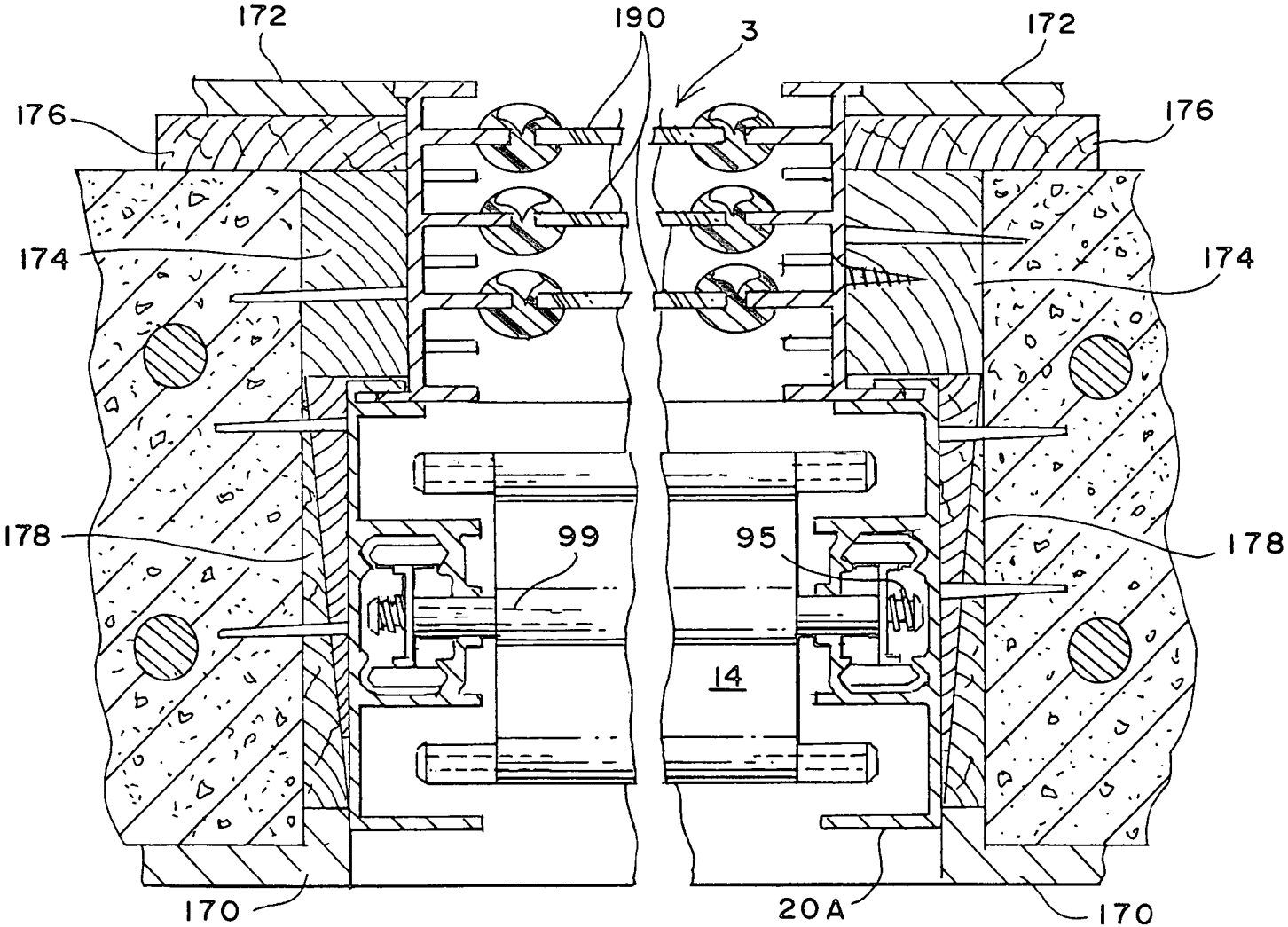
FIG. 20 is yet another alternative transverse view showing the utilization of three window/door panes which could be a sliding glass door, fixed glass door, or screen.

Having described the pleated nature of the panels, attention should be directed to FIG. 10 where the raising and lowering of the panels, from storage into deployed and deployed into storage configuration is shown as controlled by a rope or cable 140 wound around the spool 142. The rope or cable 140 extends through alternate ports 156 in the centrally mounted cylinder tip 154, particularly as shown in FIG. 14, has the rope knotted therebeneath. In this fashion the rope pulls up one plate 14 at a time as the plates pleatedly engage each other i the configuration as basically shown sequentially between FIGS. 3 and 4 which is the deployed configuration and FIG. 5 which is the storage configuration. More specifically, as shown in FIG. 14, the rope or cable 140 penetrates the cylindrical tip 154 and is secured by a knot. Alternatively, as shown in FIG. 10, the guide mount assembly 90 and wheels 120 can be secured at the central position of the plate 14 by utilizing the guide mount assembly 90 and wheels 120 can be secured at the central position of the plate 14 by utilizing the guide mount assembly 90 and wheels 120 can be secured at the central position of the plate 14 by utilizing the guide mount assembly 90 to engage the plate channel 152, as illustrated in FIG. 16 and 20. That is to say, the showing in FIG. 14 can be reversed so that the wheel carrier 118 and its associated wheels 120 take the plate mid-position as shown in FIGS. 16 and 20, with the tension member such as rope 140 being secured to the wheel carrier 118. In this fashion maximum stability is imparted to the assembly since the weight of the panels 12 pivots centrally about the guide mount 90. Similarly, when raised by the rope 140, the weight of the panel assembly 12 and the individual plates 14 is neatly balanced about the guide mount 90. As the panel assembly 12 and its associated plates move upwardly or downwardly, the opening stop assembly rollers 130 engage the outer guide channel 20A. This engagement is best shown at the left hand portion FIG. 10.

Figure 11:
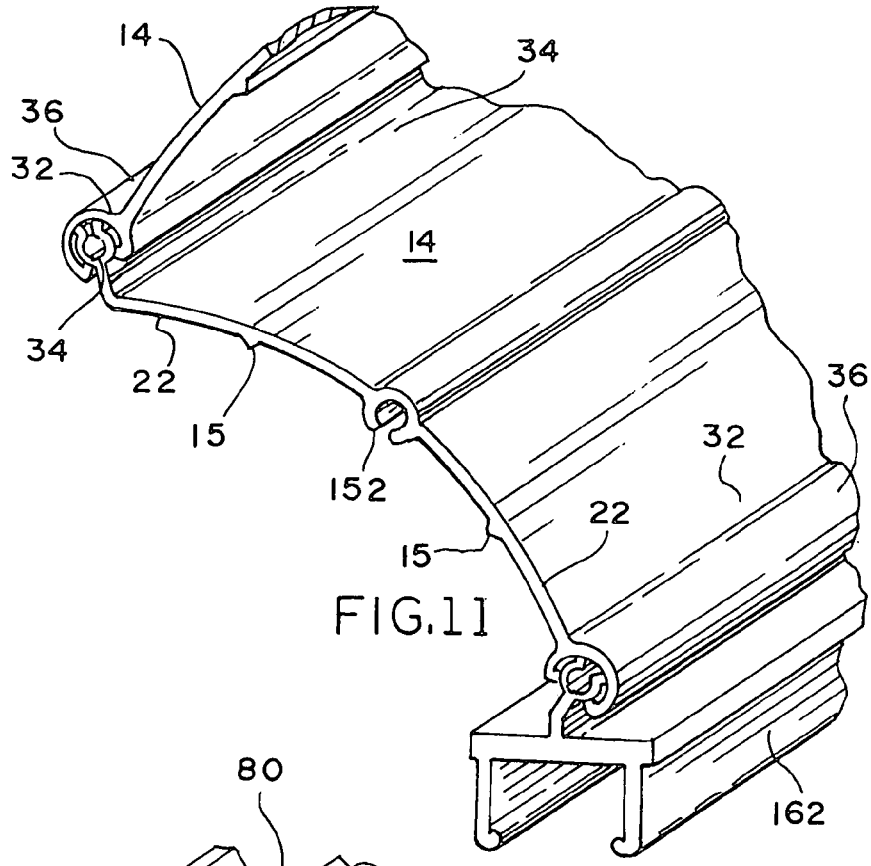
FIG. 11 is a broken away perspective view of two interconnected plates in a deployed, corrugated position, the lower plate being pivotally connected to a window sill anchoring member with a center tubular plate channel which becomes the lifting point on the bottom elongate plate.

While FIG. 11 shows the plate channel 152 in a longitudinal central position of the plate, additional ribs 14 are provided for strengthening, as shown in the lower face of the plates 14 in FIB. 11. FIG. 11 also shows the optional sill bar 162 which bottoms out at the bottom of the opening, whether it be a window or door. Sill latch 164 is provided at the bottom of the sill bar 162 for locking, as shown diagrammatically in FIG. 3. Alternative forms of sill bars 162 and locks are contemplated, or the same can be omitted when the minimum weight of the panel assembly 12 permits.

Various embodiments of the carriage and support for the panel assembly 12 and its plurality of plates have just been described. Since no specific combination has been identified as superior over the others, it will be appreciated that sill activity of the carriage mount on one end of the pleated plates or in a mid-position readily provides one or two embodiments. Alternative positioning of the tension member or rope 140 provides yet another embodiment. When a door is mounted rather than a window, yet another embodiment of the present invention is illustrated. Thus the flexibility of the entire system, proceeding from a single extruded plate 14, becomes evident.

Numerous installation alternatives exist for the subject composite frame shutter, and window or door. Examples are shown in FIG. 16 through 21.

Figure 16A:
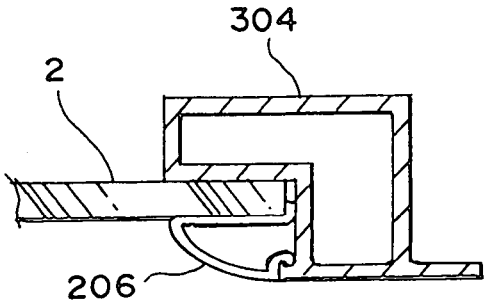
FIG. 16A is an enlarged bullet section of the window frame shown in FIG. 16.

As will be seen in FIG. 16, the exterior periphery portions are covered with the outer wall stucco 170, which stucco covers jam block 171 and drywall 172 primarily on the interior portion of the opening. As will be noted in FIG. 16A, a glass snap brace or trim 206 is employed to secure the window glass in place. The optional side shim 178 is shown as a split wedge member which permits sliding the wedge portion and trimming the edges to snugly take up the space between the edge of the frame for the shutter system and the wall. Wood screw 184 secures the lateral side guides member 20 of the frame to the shims 178. Corner frame assembly 175, 179 surrounds the interior corner of the unit, which is covered over by dry wall 172 to finish the interior of the dwelling. Also to be noted is the cast window sill 204 which is in the interior portion of the room.

Figure 17:
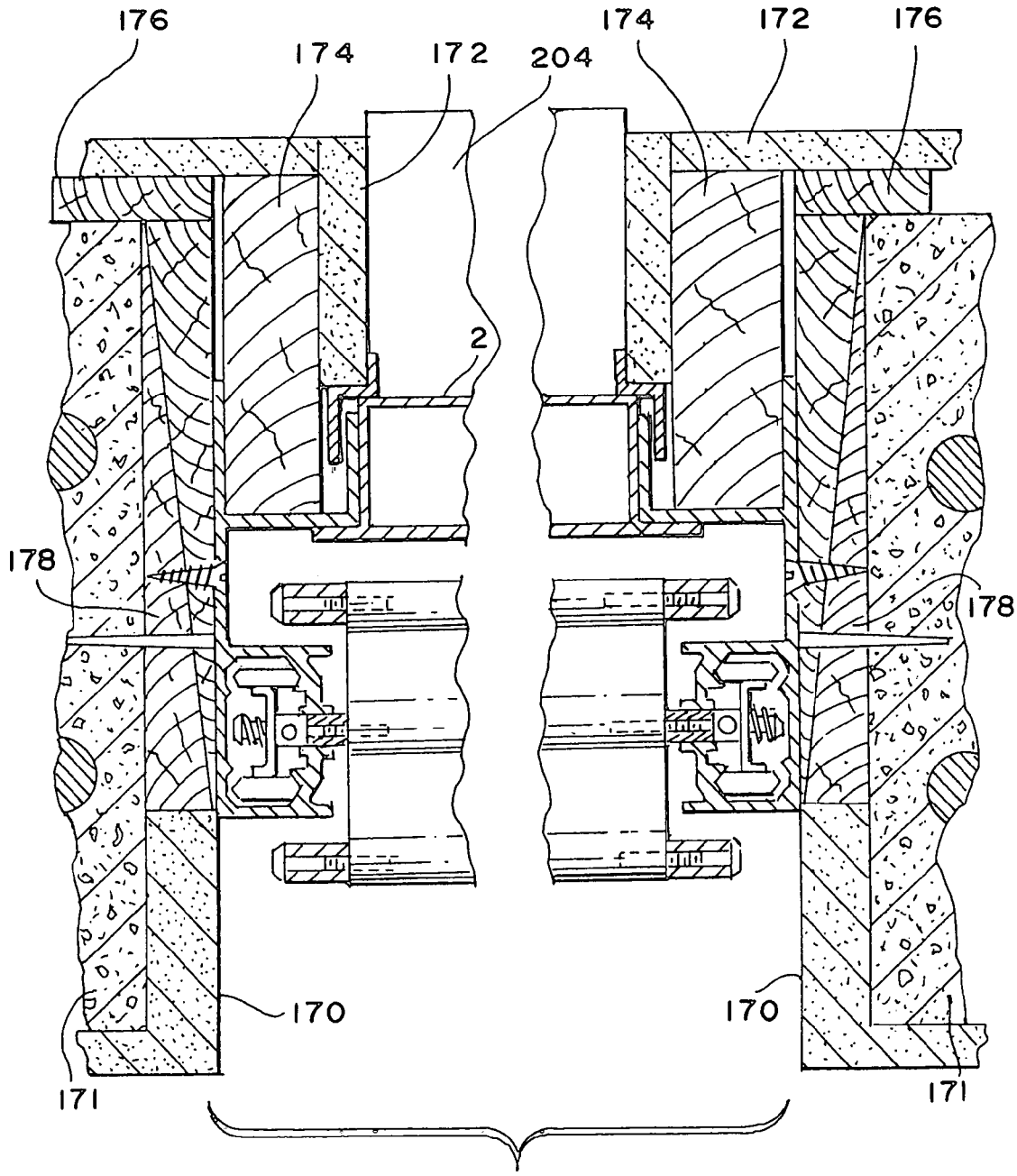
FIG. 17 is an alternative view of a transverse section of a window from that of FIG. 16, showing alternative framing, shimming, and stucco application.

As shown in FIG. 17, the outer wall stucco 170 is applied to the outer portion of window jam block 171. Furring strips 176 and window buck 174 frame the corner portion. The corner portion on the outside is covered by the outer wall stucco 170. The split side shim 178 is also employed. However, the inner portion includes an extended sill 204 and framing by means of dry wall 172.

Figure 18:
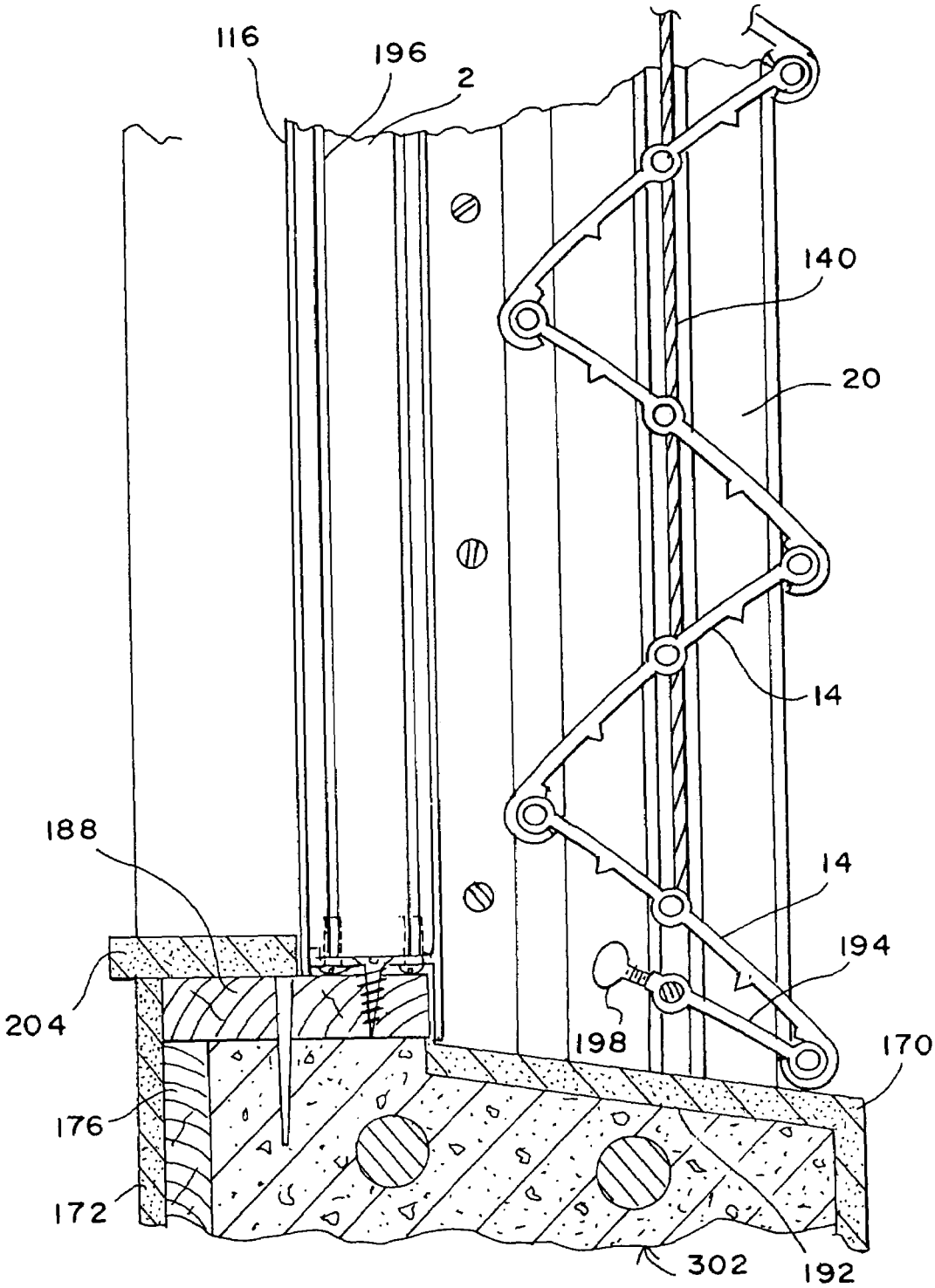
FIG. 18 is an end view taken in section from the lower portion of the window and plates shown in FIG. 16.

FIG. 18 now shows the lower portion of the window where at the bottom it will be seen that it is sloped outwardly for drainage and covered with the outer wall stucco 170. The precast opening sill 302 finishes out the outer lower edge of the opening. There is an optional sill shim 188 and lower furring strip 176 on the inner portion, with dry wall 172 underlying the cast sill 204. The pleating of the plates includes the provision at the very lower portion for a slide pin 198. When the slide pin is open, it permits the removal of the plates or adjustment of the plates or even the replacement of the rope 140. The lower block opening sill 302 is formed with the tapered precast sill portion 192.

Figure 19:
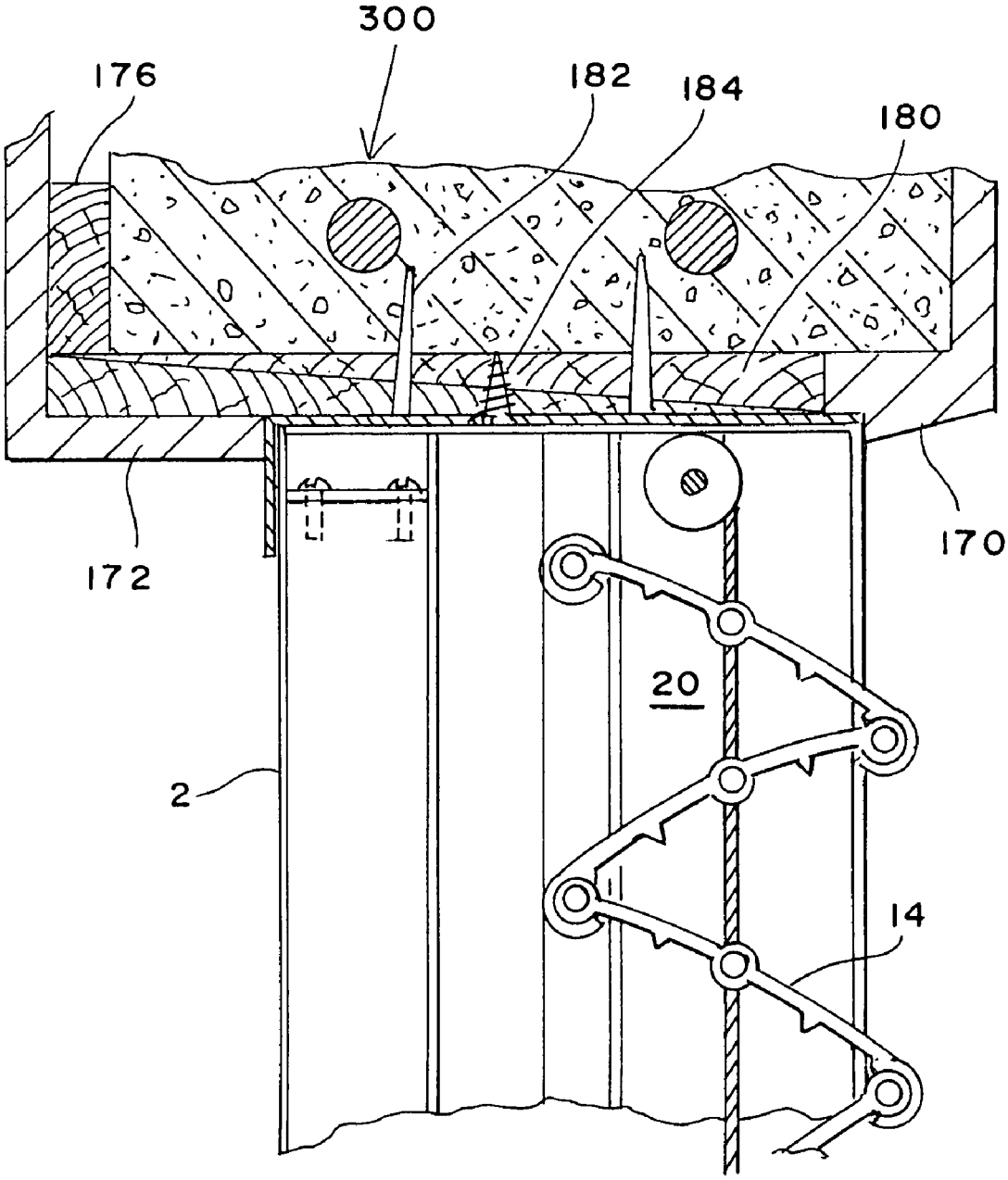
FIG. 19 is a view in similar scale to that of FIG. 18 but showing the upper portion of the same window and plates and the joinder of the frame to the overlying portion of the window opening.

FIG. 19 is taken at the upper portion of the shutter window combination shown in FIG. 18. There will be seen that concrete fasteners 182 are used at the top to secure the frame of the shutter window system to the concrete header precast tie beam 300. The optional header shim 180 with the opposed wedge members is also shown secured by wood screw 184, which on the inner portion of the dwelling is covered over with dry wall 172. At the outer portion, the stucco 170 is formed in order to abut the optional header shim 180. At the outer portion, the stucco 170 is applied uniformly to surround the 90° bend.

The principal difference between the environment shown in FIG. 20 and the other figures is the contemplation of a sliding glass door 190 which can be made up of one sliding member and a static member, two sliding members and a static member, all three members sliding, or two members optionally static or movable in combination with a screen, or finally a multiple member screen. All of these alternatives are optional and illustrative of the flexibility of the invention itself. More specifically note should be taken of the window buck 174 on the interior portion for mounting the window or door, which is overlaid by furring strips 176 and finished off with dry wall 172.

Figure 21:
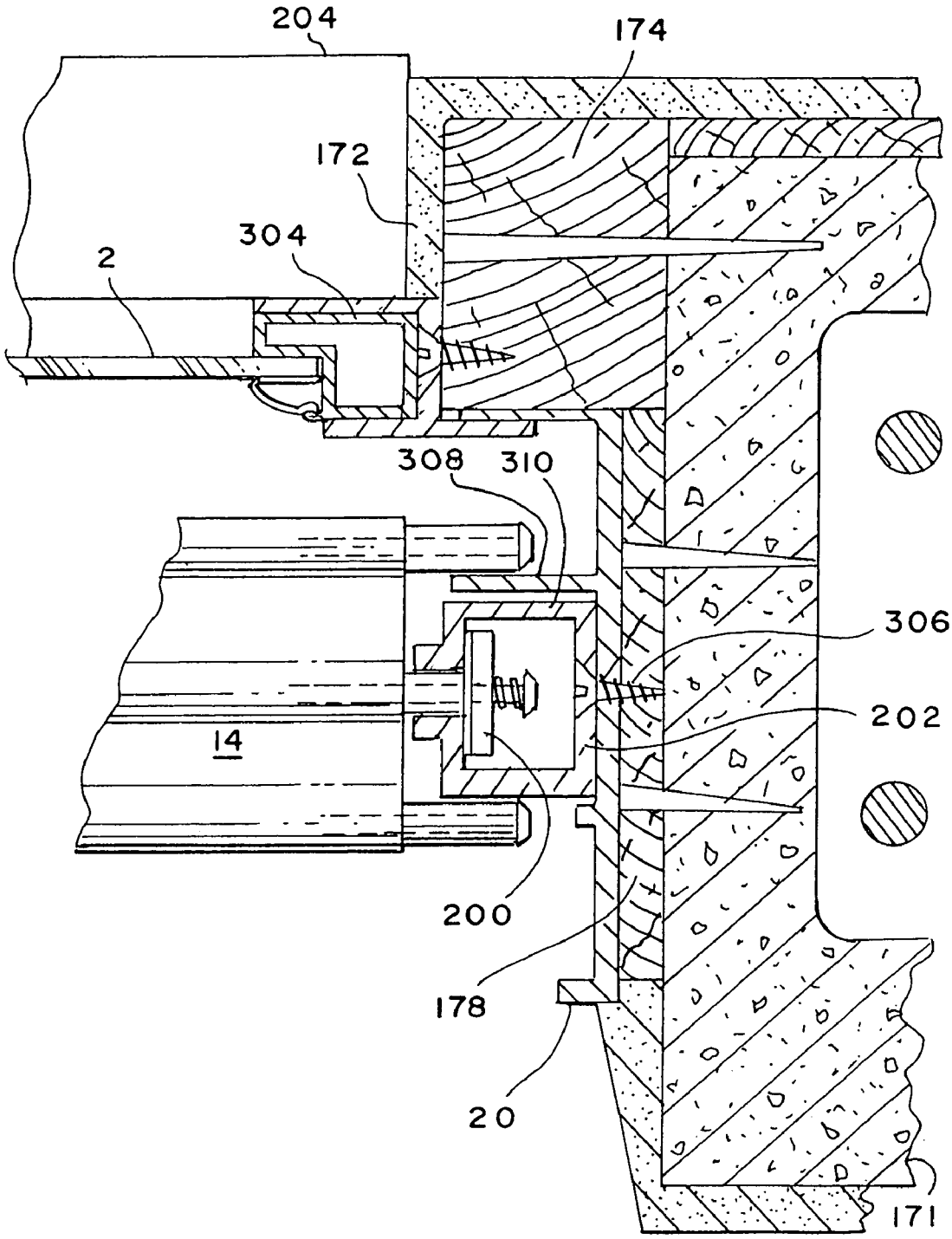
FIG. 21 shows an alternative embodiment showing a fixed glass window and taken from the same vantage point as FIG. 16 but utilizing a removable slide guide housing and guide.

Finally, the alternative embodiment in FIG. 21 utilizes a single removable washer slide guide 200 in place of the wheels and tracks. The advantage of this construction is that when the shutter portion is totally elevated, access can be had to remove the adjustment screws 306 which permits removal of the entire shutter and its track system for repair, replacement, or adjustment. To provide for this end system a guide inner seat 308 and guide channel outer block 310 nestingly retain the entire shutter system. Otherwise the utilization of furring members, bucks, and related structural members are shown illustrative again of the flexibility of Applicant's inventive system.

In review it will be seen that a composite frame assembly for either a window or a door, including a preselected and preestablished storm shutter has been disclosed and described. The method of making the unit, and its alternatives have also been described. The method of installation, while straight forward, is virtually impossible without the package. On the other hand, the contractor is assured that the dimensional relationship between the frame, window, or door, and shutter system will be preestablished by carefully dimensioned extrusions in part at the factory before it arrives a the job site. This being the case, the job site is at the installation point for the inventive system which, with a simple application, can be installed by one or two men in a very short period of time. Furthermore, such an installation ensures dimensional accuracy, and permanence in position and operation.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A shutter system in combination with an architectural feature being one of a door and a window unitized in a rectangular bracket for use in a building opening comprising:

a plurality of plates disposed within the rectangular bracket which can be folded and unfolded, each of the plates having hollow hinge forming longitudinal parallel edges which together form hinged joints;

guide members in the rectangular bracket having tracks for guiding the plates;

extensions with rollers from each of the hinged joints to cooperate with the guide members;

further extensions extending from ends of the plates on no less than every other plate;

each of the further extensions having supporting members with wheel carriers secured at the end of the plate and within a track with yieldable means urging the wheel carriers to put the secured plate in tension to add additional strength to resist bending and impact of the shutter when in a fully unfolded configuration.

2. The shutter system of claim 1 in which each hinged joint includes two hollow hinge members that are substantially cylindrical, one of the hollow hinge members being formed to slide interiorly of the other hollow hinge member whereby the shutter may be assembled by slidably engaging adjacent plates.

3. The shutter system of claim 1 in which the hinged joints further comprise:

hinge members that are C-shaped in cross-section;

stop members protruding from the ends of the C-shaped cross-members extending inwardly on the larger hinge members and outwardly on the smaller hinge member; whereby rotation of the hinged joints at the extreme positions of folded and unfolded plates in the shutter is stopped.

4. The shutter system of claim 3 in which one hollow hinge member includes a swarf channel throughout its longitudinal length, the swarf channel being positioned opposite a gap between the stop members.

5. The shutter system of claim 1 in which the plates are a one piece member formed of a single extrusion whereby each plate is interchangeable each other plate.

6. The shutter system of claim 5 in which:

the plate members include an arcuate surface facing concave downwardly; and at least two longitudinal ribs are extruded along the lower concave portion of said plate member to provide additional reinforcing strength in tension.

7. The shutter system of claim 1 which further comprises:

means for raising and lowering the plates while they are constrained horizontally within the bracket.

8. The shutter system of claim 1 in which the wheel carriers are disposed at one of an edge and a mid-position of each plate whereby at all times the plates are carried in tension to add additional strength to resist bending and impact and whereby at all times the plates are constrained against lateral displacement by the wheel carriers running up and down the tracks.

9. The shutter system of claim 1 in which the rectangular bracket is proportioned to receive one of a sliding glass door, a curtain wall, and a full view picture window as the architectural feature.

10. A method for installing in a building opening the shutter system and architectural feature unitized system of claim 1, comprising the steps of:

framing the rectangular bracket with a frame having a top and sides, inserting the combination shutter system into a building opening, and securing split shims on the lateral sides of the frame.

11. The shutter system of claim 1 in which the plates are a one piece member formed of a single extrusion whereby each plate is interchangeable each other plate.

12. The shutter system of claim 11 in which:

the plate members include an arcuate surface facing concave downwardly; and at least two longitudinal ribs are extruded along the lower concave portion of said plate member to provide additional reinforcing strength in tension.

13. The shutter system of claim 1 which further comprises:

means for raising and lowering the plates while they are constrained horizontally within the bracket.

14. The shutter system of claim 1 in which the additional extensions are disposed at one of an edge and a mid-position of each plate whereby at all times the plates are carried in tension to add additional strength to resist bending and impact and whereby at all times the plates are constrained against lateral displacement by the washer slide guide being constrained within the guide channel outer blocks.

15. The shutter system of claim 1 in which the rectangular bracket is proportioned to receive, one of a sliding glass door, a curtain wall, and a full view picture window as the architectural feature.

16. A shutter system in combination with an architectural feature being one of a door and a window unitized in a rectangular bracket for use in a building opening comprising:

a plurality of plates disposed within the rectangular bracket which can be folded and unfolded, each of said plates having hollow hinge forming longitudinal parallel edges which together form hinged joints;

guide members in the rectangular bracket having guide inner seats for guiding said plates;

the guide members including guide channel outer blocks disposed between guide inner seats;

extensions with rollers from each of the hinged joints to cooperate with the guide members;

further extensions extending from ends of the plates on no less than every other plate;

each of the further extensions having a removable washer slide guide secured at the end of each said further extension and being constrained within the guide channel outer blocks with yieldable means urging the washer slide guide to put the secured plate in tension, to add additional strength to resist bending or impact of the shutter when in a fully unfolded configuration.

17. The shutter system of claim 16 in which each hinged joint includes two hollow hinge members that are substantially cylindrical, one of the hollow hinge members being formed to slide interiorly of the other hollow hinge member whereby the shutter may be assembled by slidably engaging adjacent plates.

18. The shutter system of claim 16 in which the hinged joints further comprise:

hinge members that are C-shaped in cross-section;

stop members protruding from the ends of the C-shaped cross-members extending inwardly on the larger hinge members and outwardly on the smaller hinge member;

whereby rotation of the hinged joints at the extreme positions of folded and unfolded plates in the shutter is stopped.

19. The shutter system of claim 18 in which one hollow hinge member includes a swarf channel throughout its longitudinal length, the swarf channel being positioned opposite a gap between the stop members.

20. A method for forming a combination shutter system and architectural feature unitized system in a rectangular bracket for insertion into a building opening comprising:

forming a series of plate members with a length governed by the width of the building opening, and having two lateral edges, each edge being tubular with a longitudinal slot to form a C-shaped member, one C-shaped member being larger than a second C-shaped member, the larger having an interior opening sufficient to slidably receive the second smaller C-shaped member to form a hinge between adjoining plates;

providing extensions from both ends of each plate to cooperate with guide members in the bracket to guide the plates;

adding further extensions attached to both ends of the plates on no less than every other plate; and attaching to the further extensions means to secure within the guide members and apply tension to the plates using yieldable means that adds additional strength to resist bending or impact of the plates.

* * * * *